US007442095B2

(12) United States Patent
Sonohara

(10) Patent No.: US 7,442,095 B2
(45) Date of Patent: Oct. 28, 2008

(54) MOTOR WITH INTEGRATED WINDING AND TERMINAL BLOCK

(75) Inventor: Hiroyuki Sonohara, Nagano (JP)

(73) Assignee: Nidec Sankyo Corporation (JP)

( * ) Notice: Subject to any disclaimer, the term of this patent is extended or adjusted under 35 U.S.C. 154(b) by 0 days.

(21) Appl. No.: 11/726,345

(22) Filed: Mar. 21, 2007

(65) Prior Publication Data

US 2007/0224858 A1 Sep. 27, 2007

(30) Foreign Application Priority Data

Mar. 22, 2006 (JP) ..... 2006-078352

(51) Int. Cl.
*H01R 4/34* (2006.01)

(52) U.S. Cl. ..... 439/808

(58) Field of Classification Search ..... 439/808, 439/100, 792, 817, 811, 812; 310/259, 71, 310/194

See application file for complete search history.

(56) References Cited

U.S. PATENT DOCUMENTS 5,944,566 A * 8/1999 Gossmann ..... 439/792
2004/0041495 A1* 3/2004 Suzuki et al. ..... 310/259
2004/0155542 A1* 8/2004 Matsuura et al. ..... 310/71
2005/0007231 A1* 1/2005 Kim et al. ..... 336/198

FOREIGN PATENT DOCUMENTS

JP 2004-147426 5/2004
JP 2005-33919 2/2005

* cited by examiner

*Primary Examiner*—Jean F Duverne
(74) *Attorney, Agent, or Firm*—Cantor Colburn LLP

(57) ABSTRACT

A motor may include a coil bobbin having a drum part around which a winding is provided, a terminal block formed on an outer periphery of the coil bobbin, at least a pair of terminal pins which are protruded from a first wall face of the terminal block, and a groove part formed in the first wall face of the terminal block and is opened to a second wall face of the terminal block that is perpendicular to the first wall face. Both ends of the winding are respectively bound to a pair of the terminal pins from the second wall face side through the groove part of the terminal block. A stator core may be utilized instead of the coil bobbin. In this case, the terminal block may be fitted to the stator core.

12 Claims, 18 Drawing Sheets

【Fig. 1】
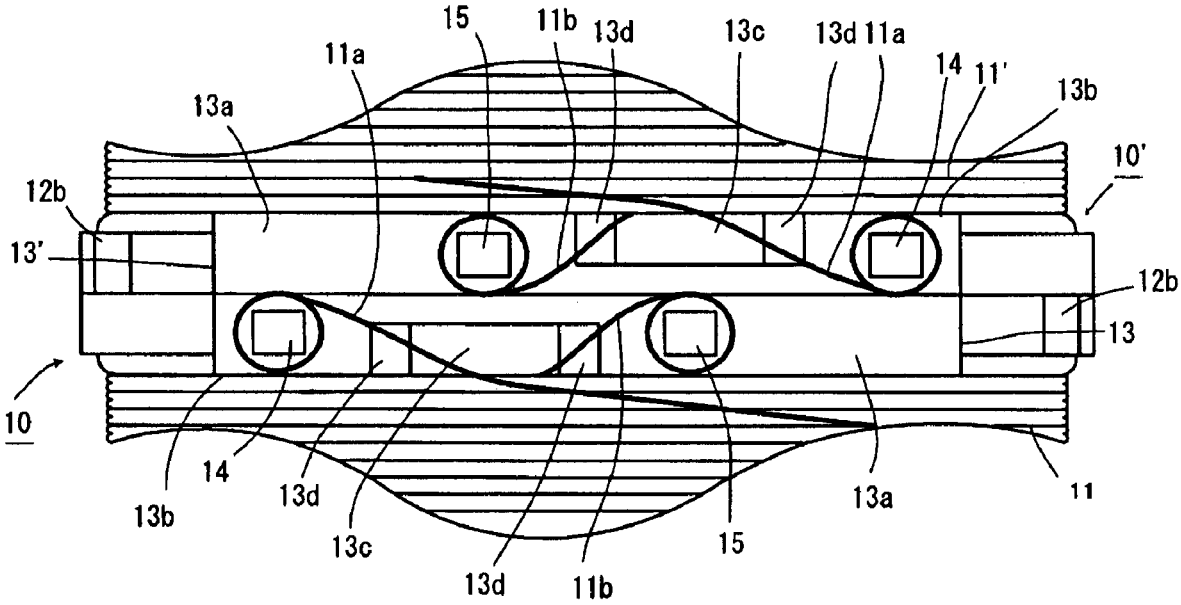

【Fig. 2】
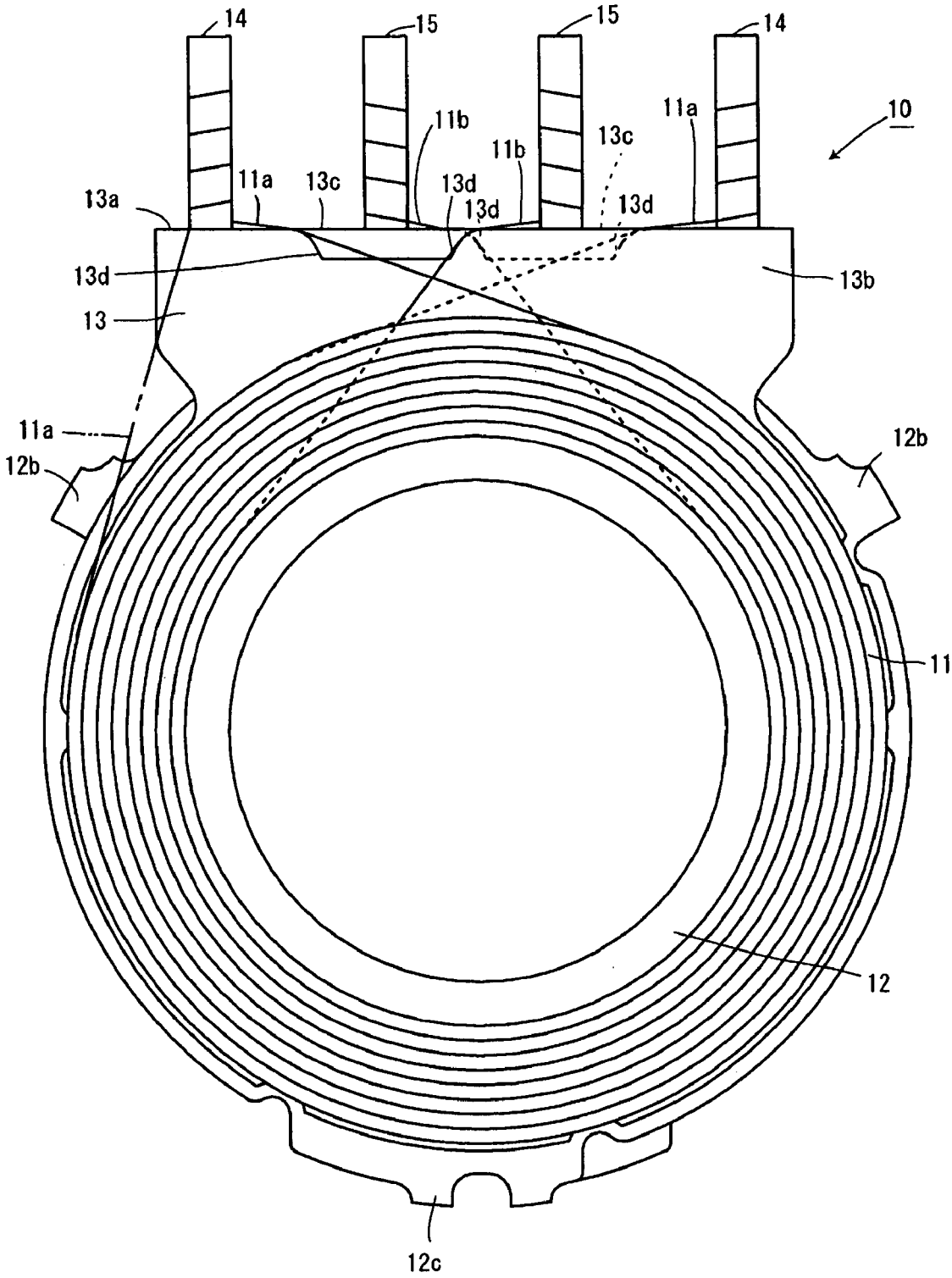

【Fig. 3】
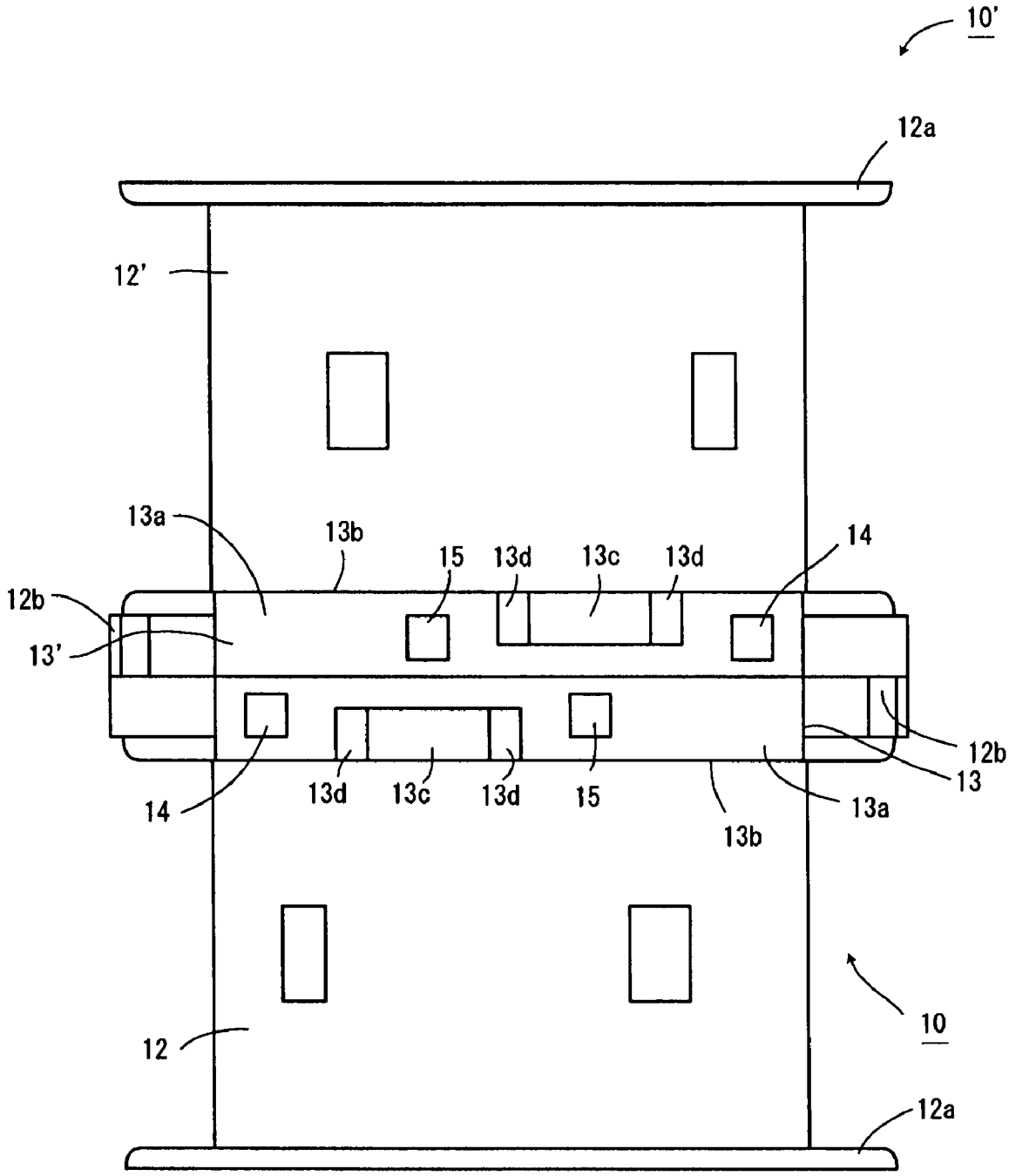

【Fig. 4】
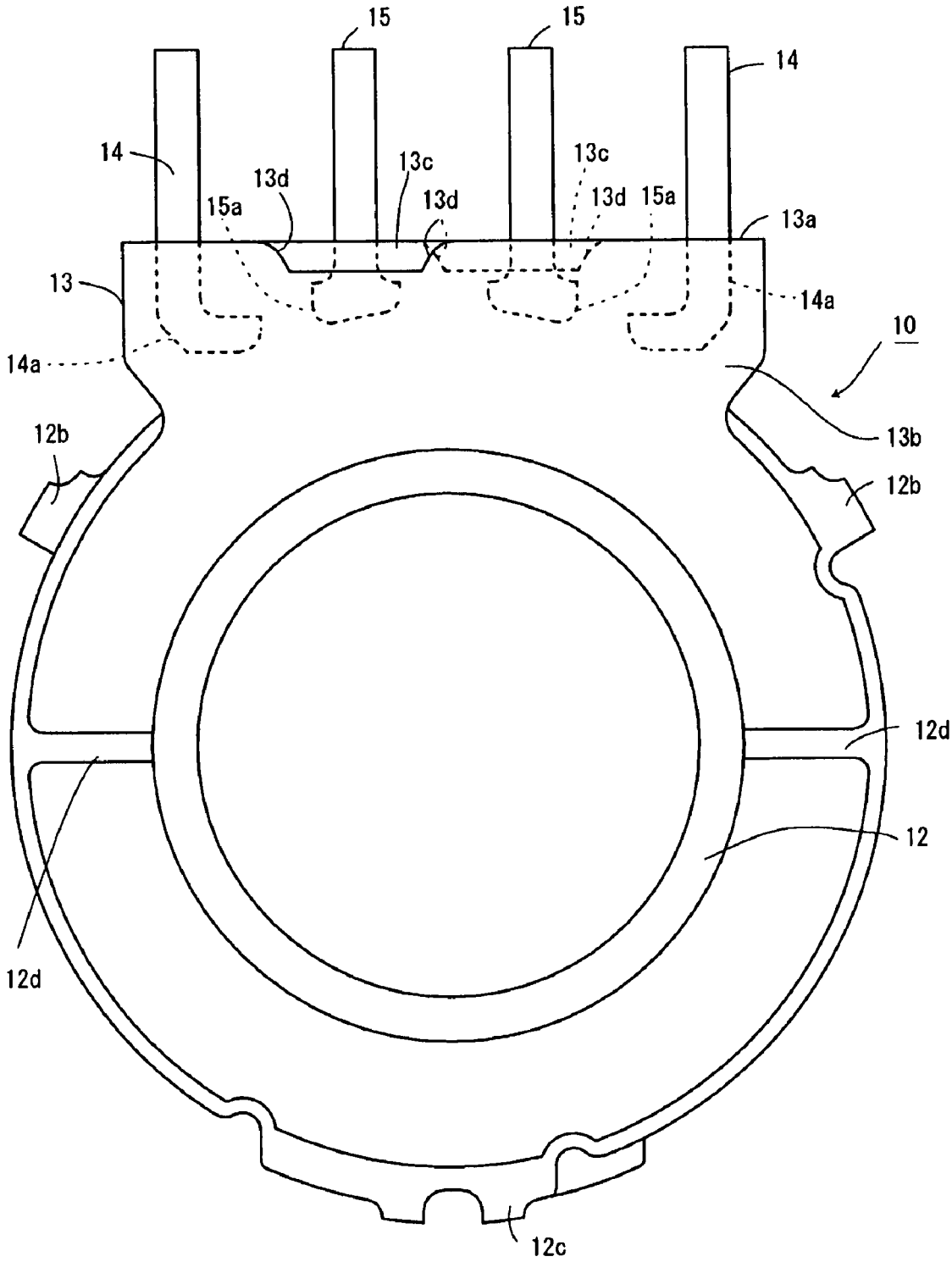

【Fig. 5】
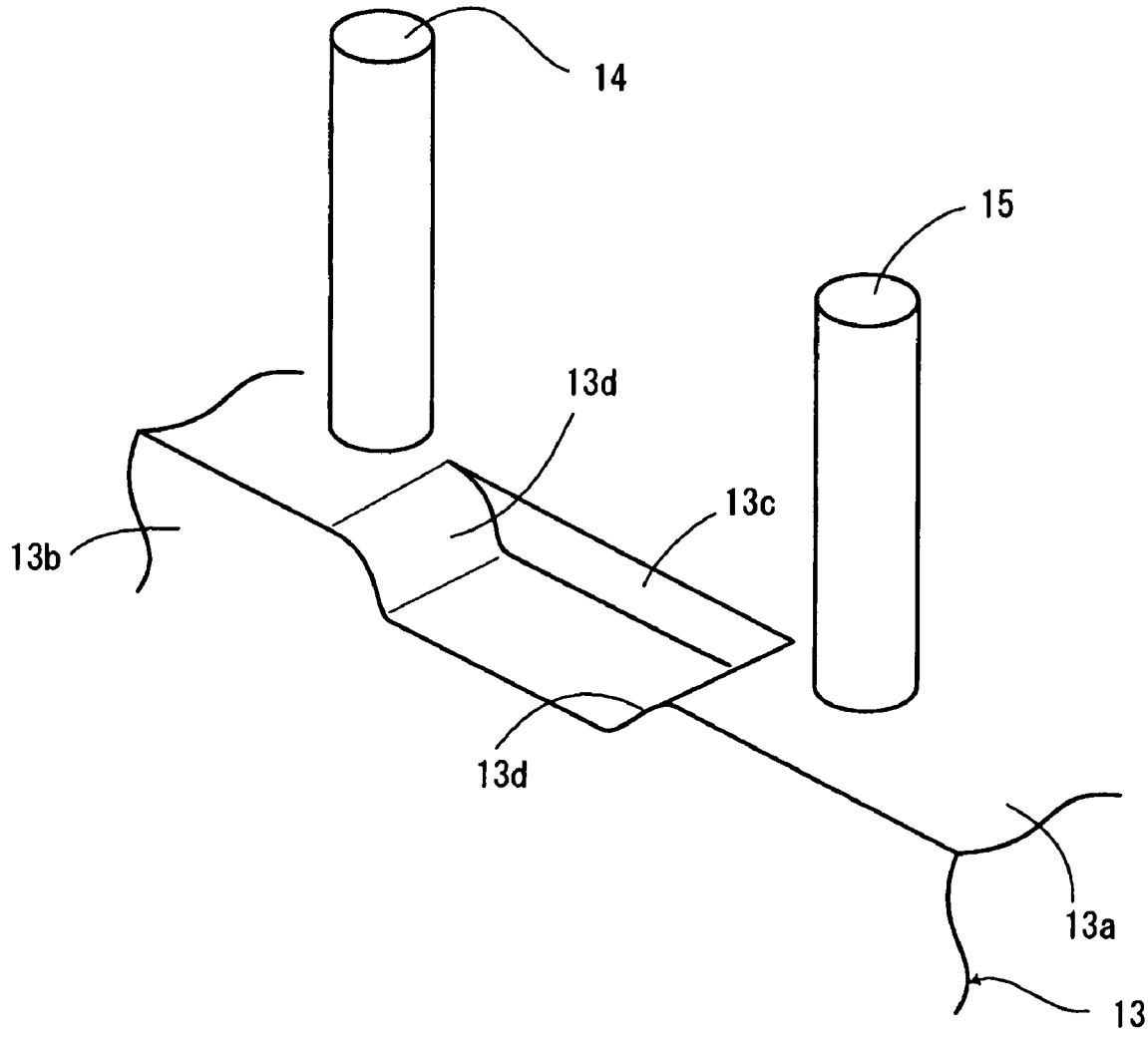

【Fig. 6】
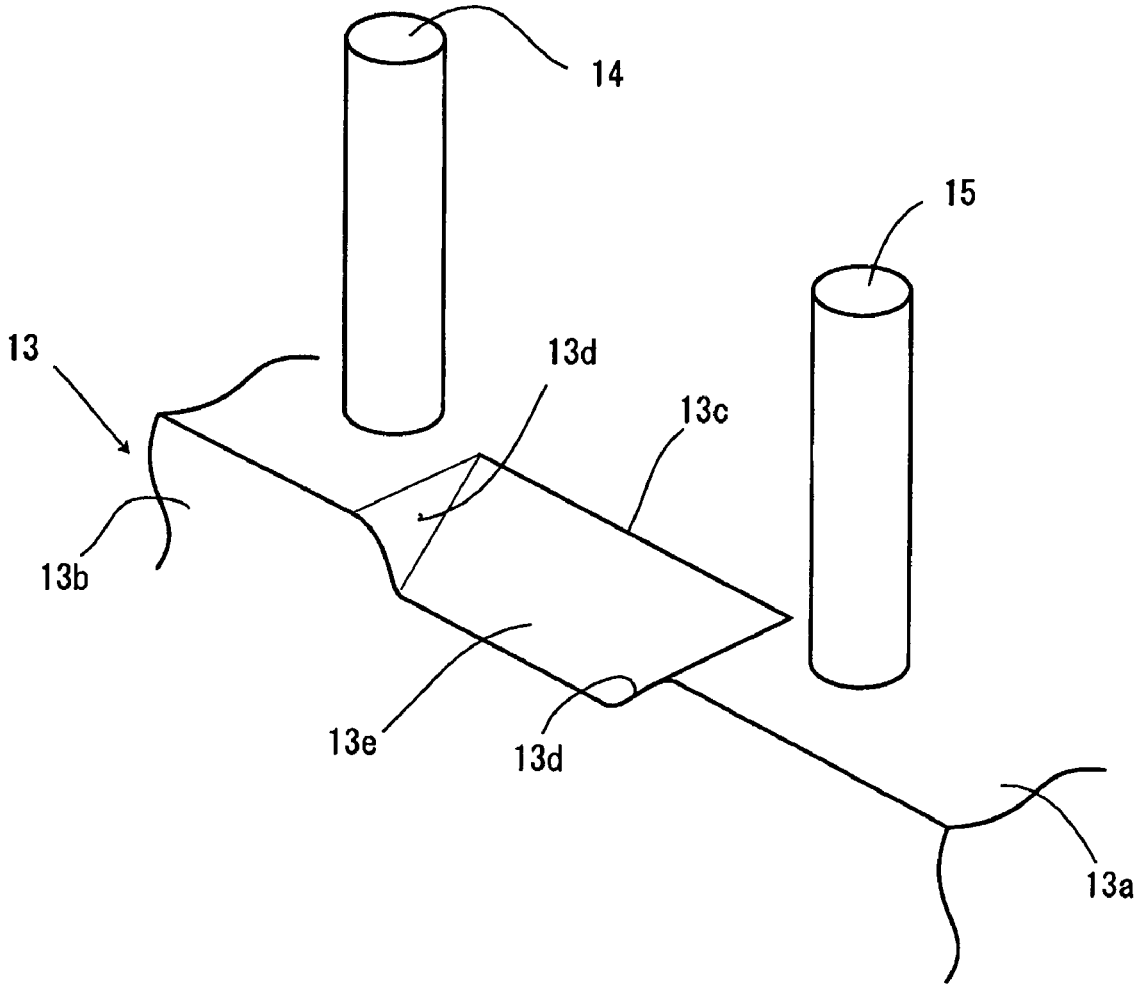

【Fig. 7】
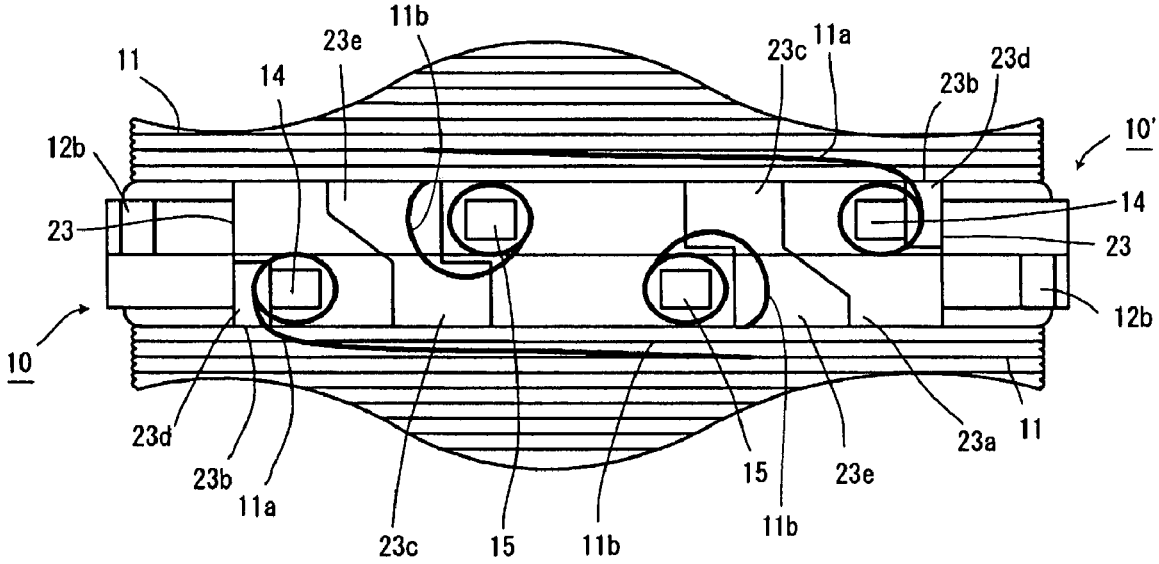

【Fig. 8】
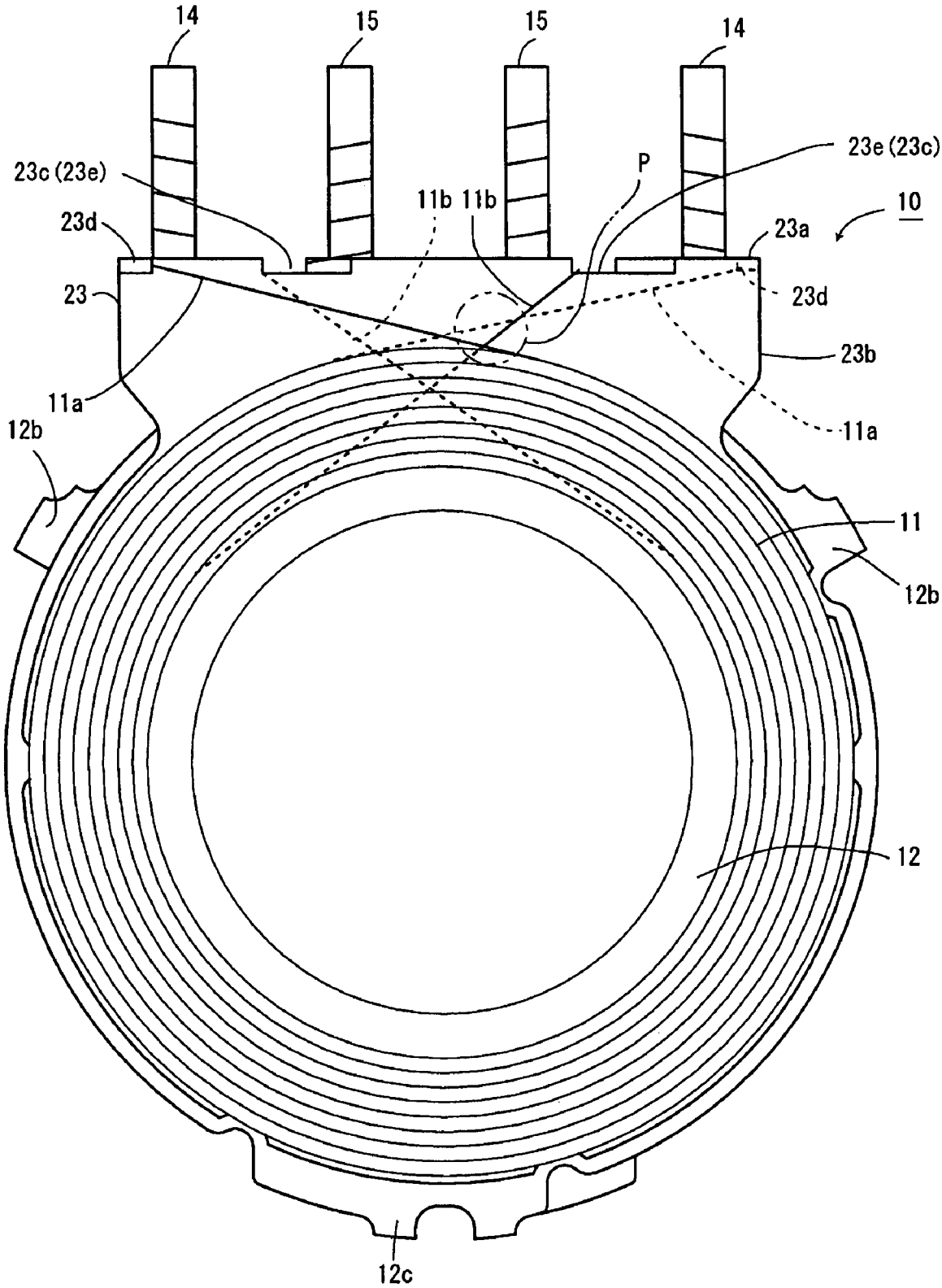

【Fig. 9】
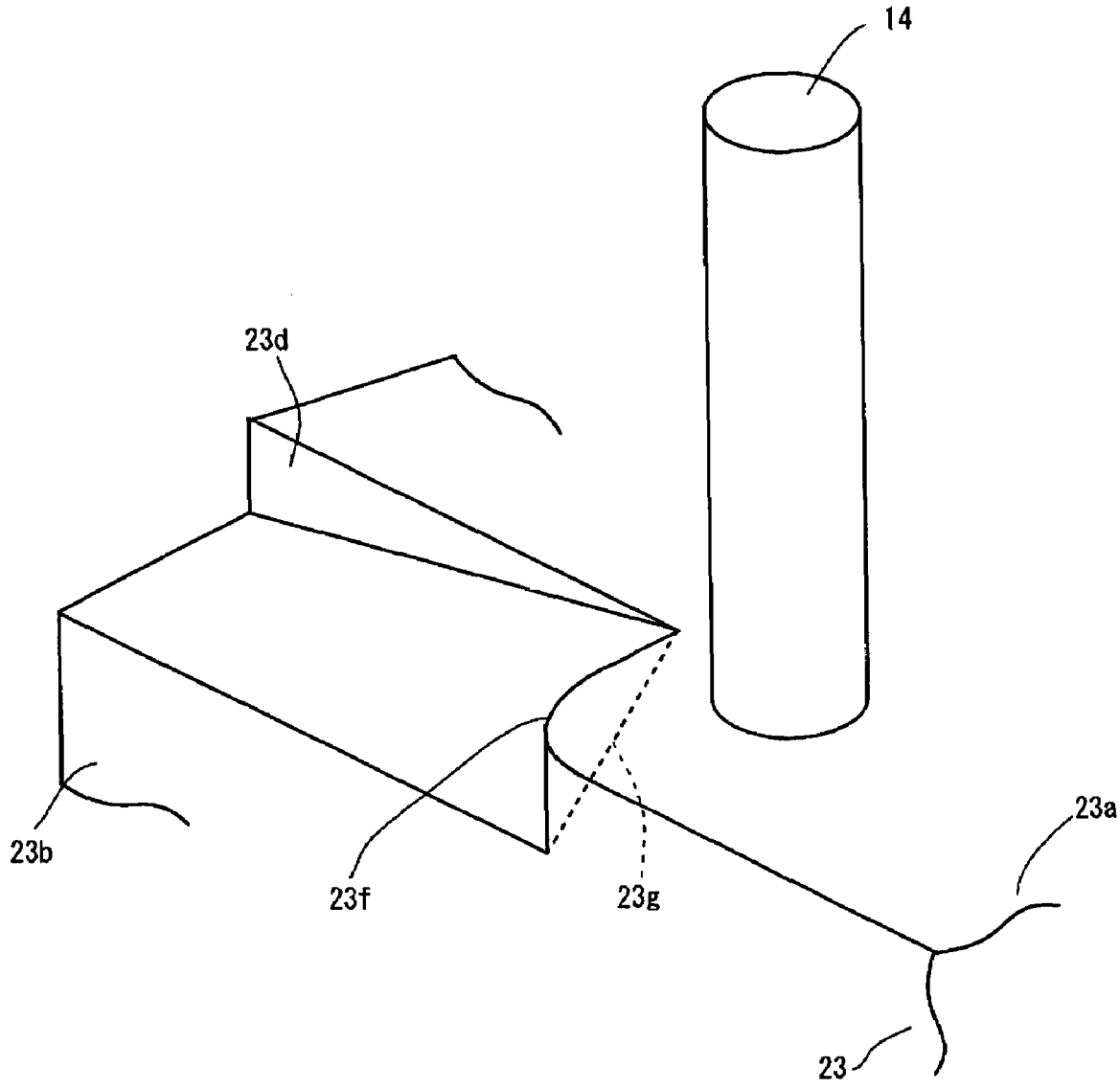

【Fig. 10】
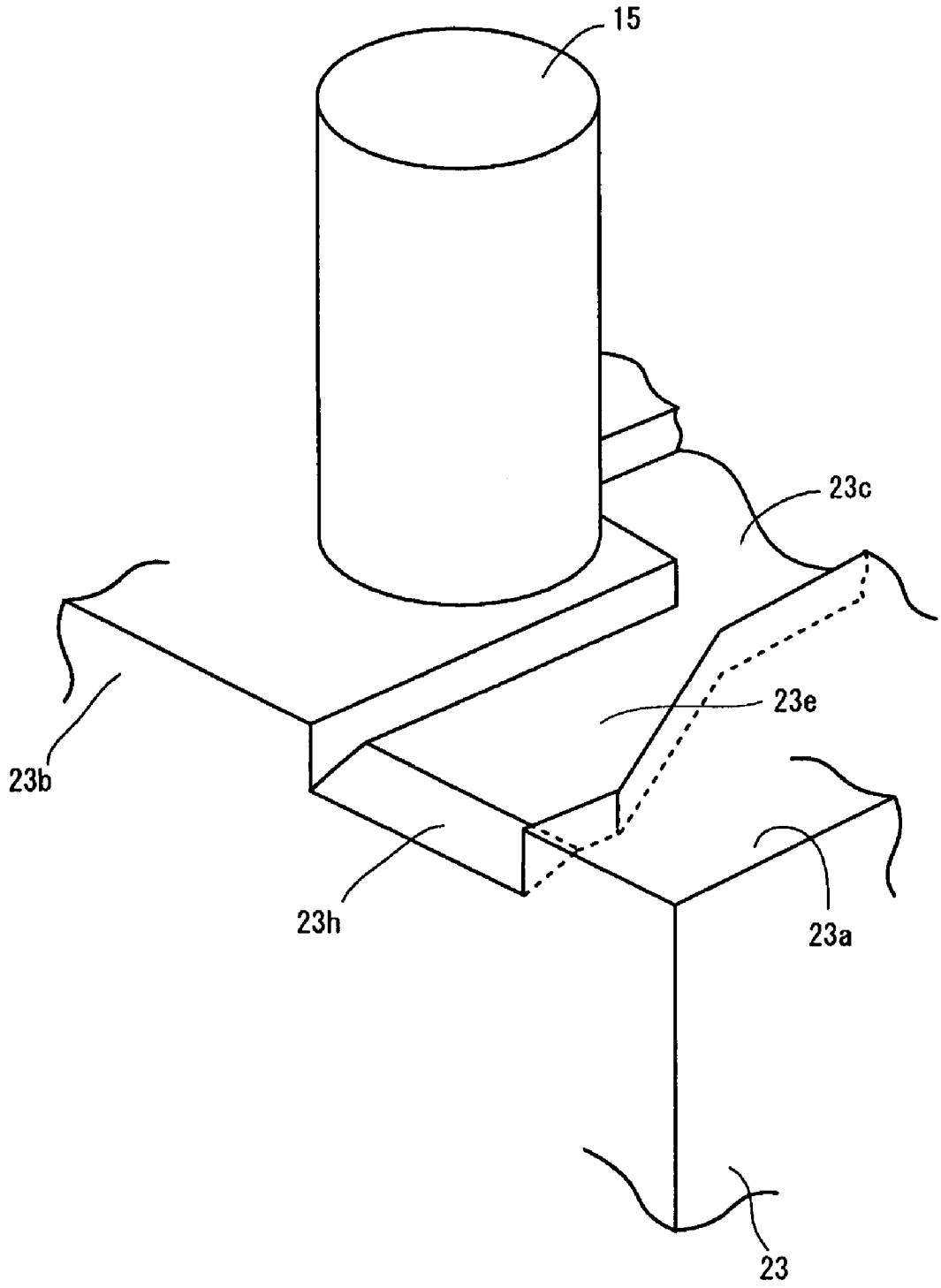

【Fig. 11】
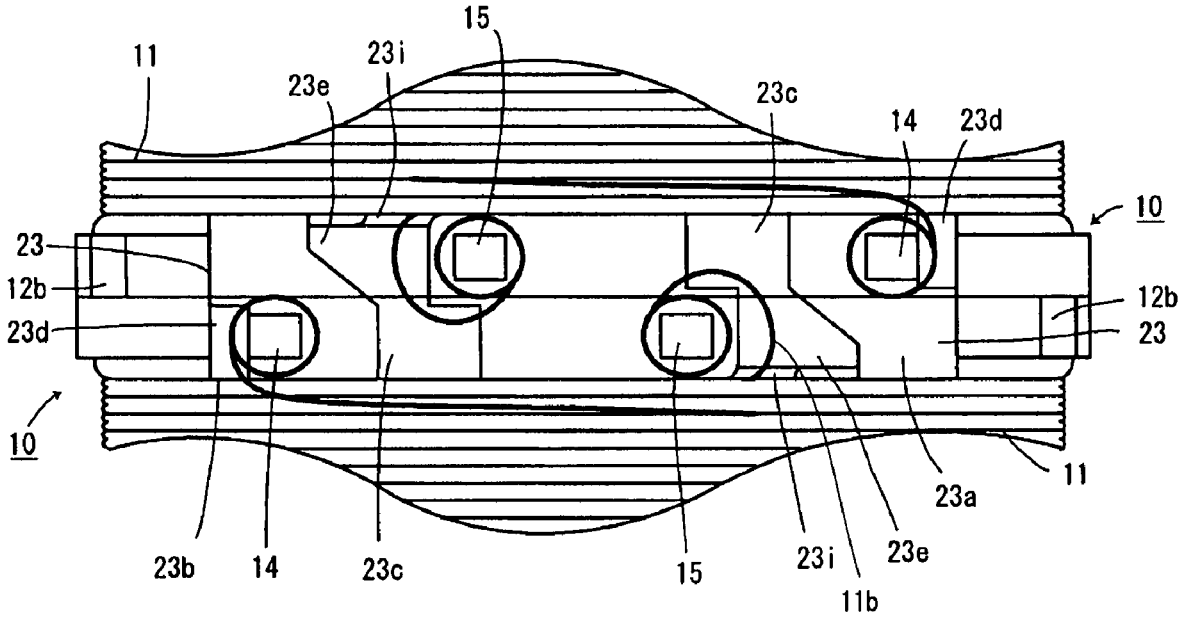

【Fig. 12】
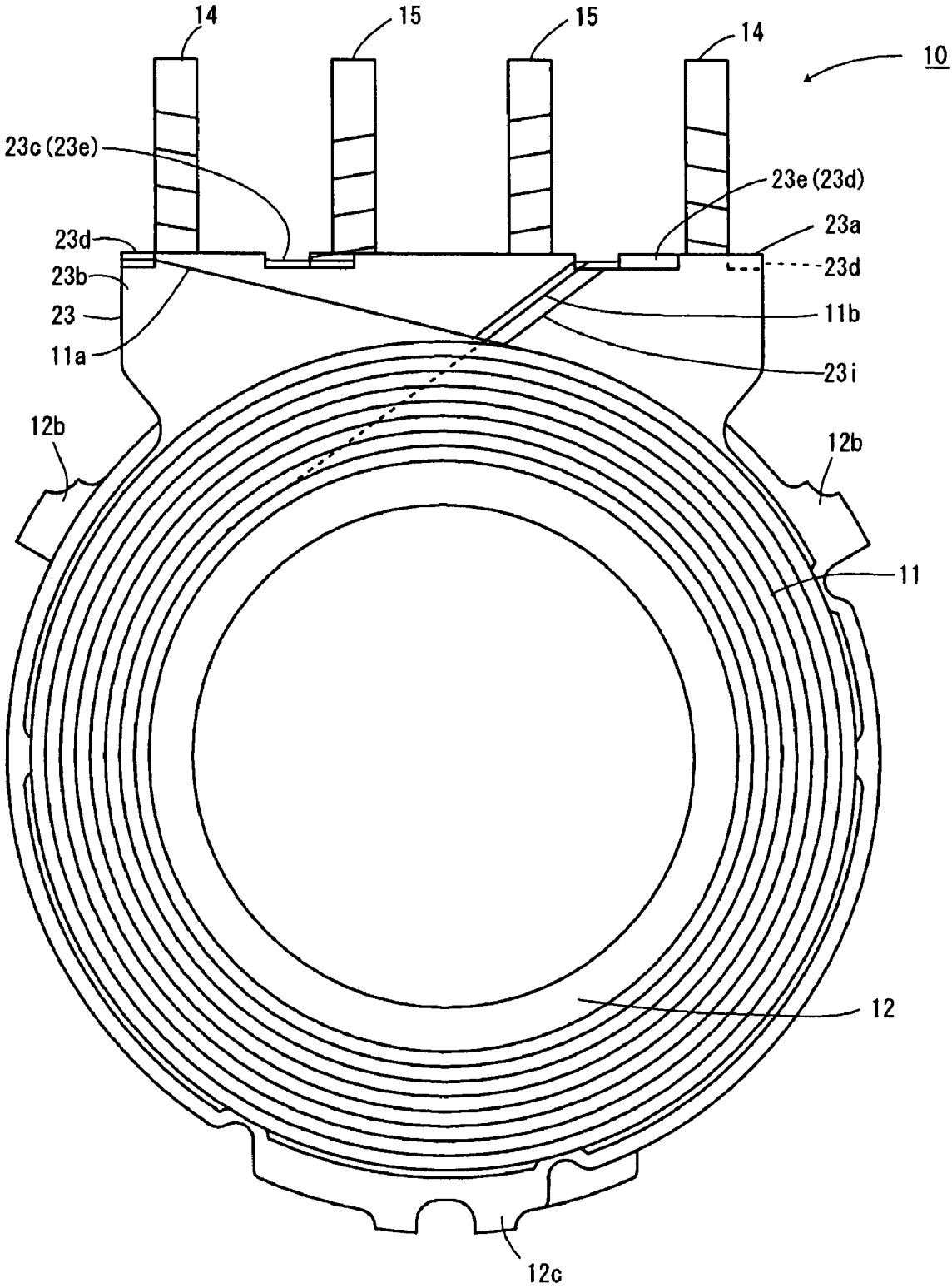

【Fig. 13】
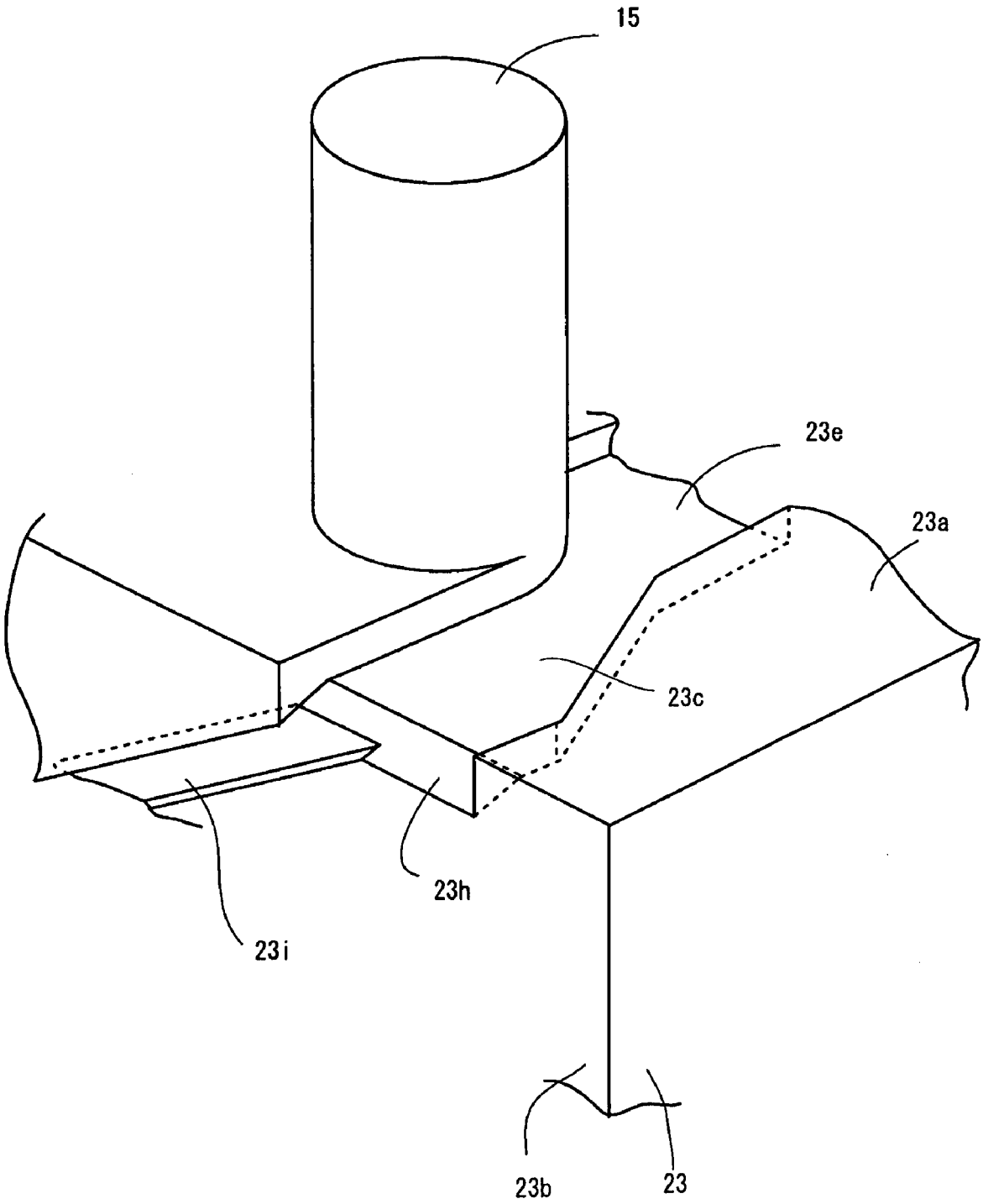

【Fig. 14】
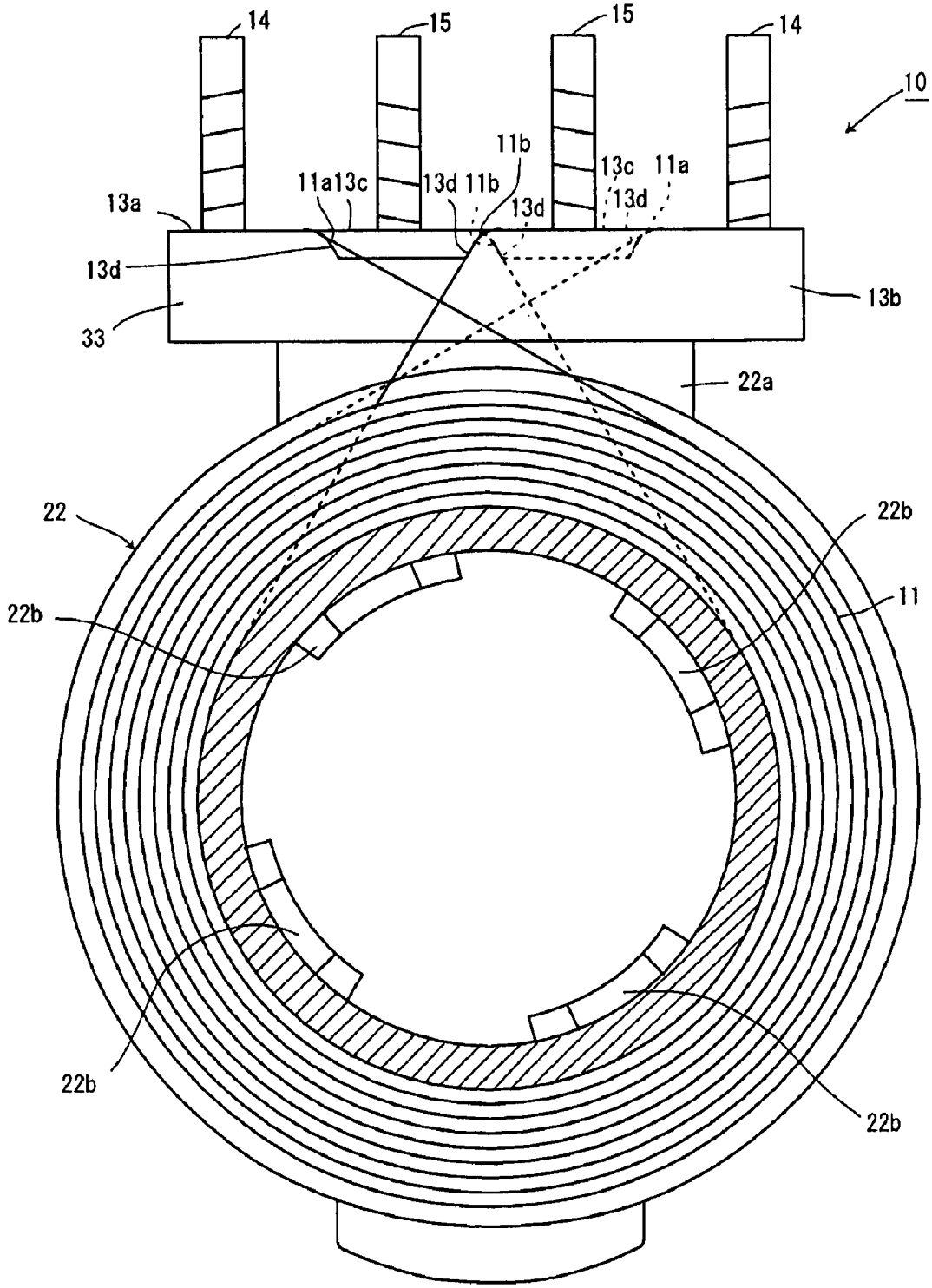

【Fig. 15】
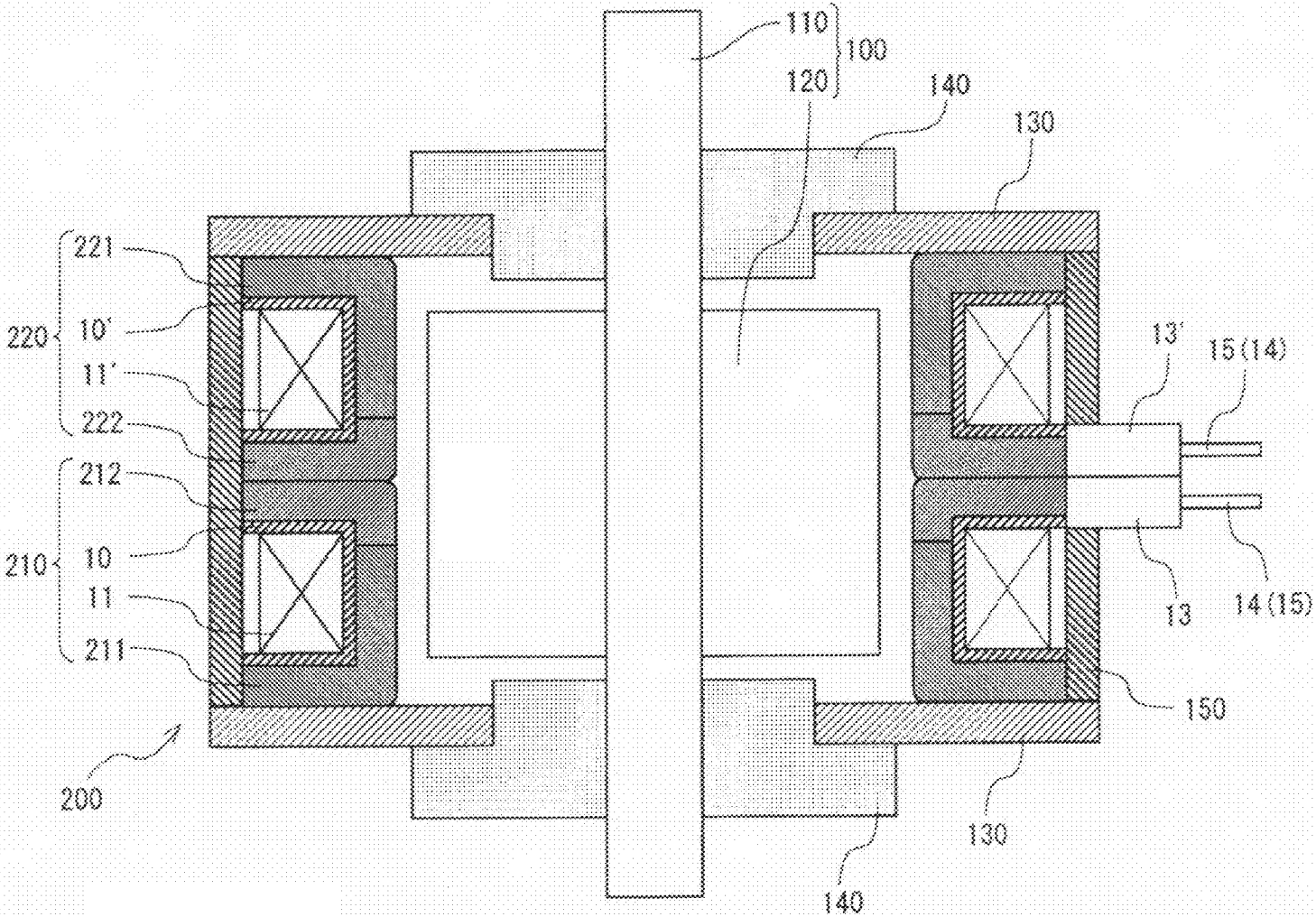

【Fig. 16】
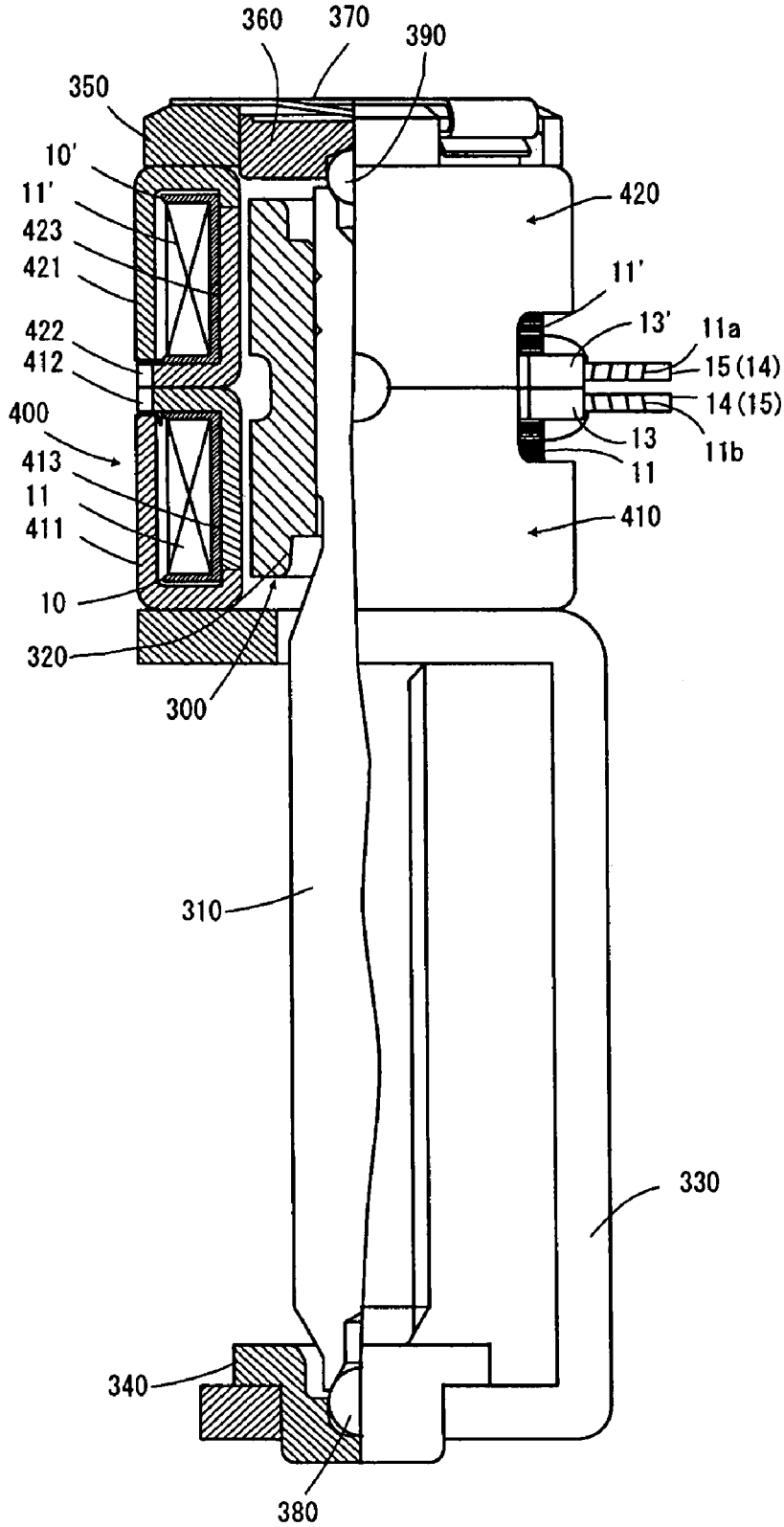

【Fig. 17】
PRIOR ART
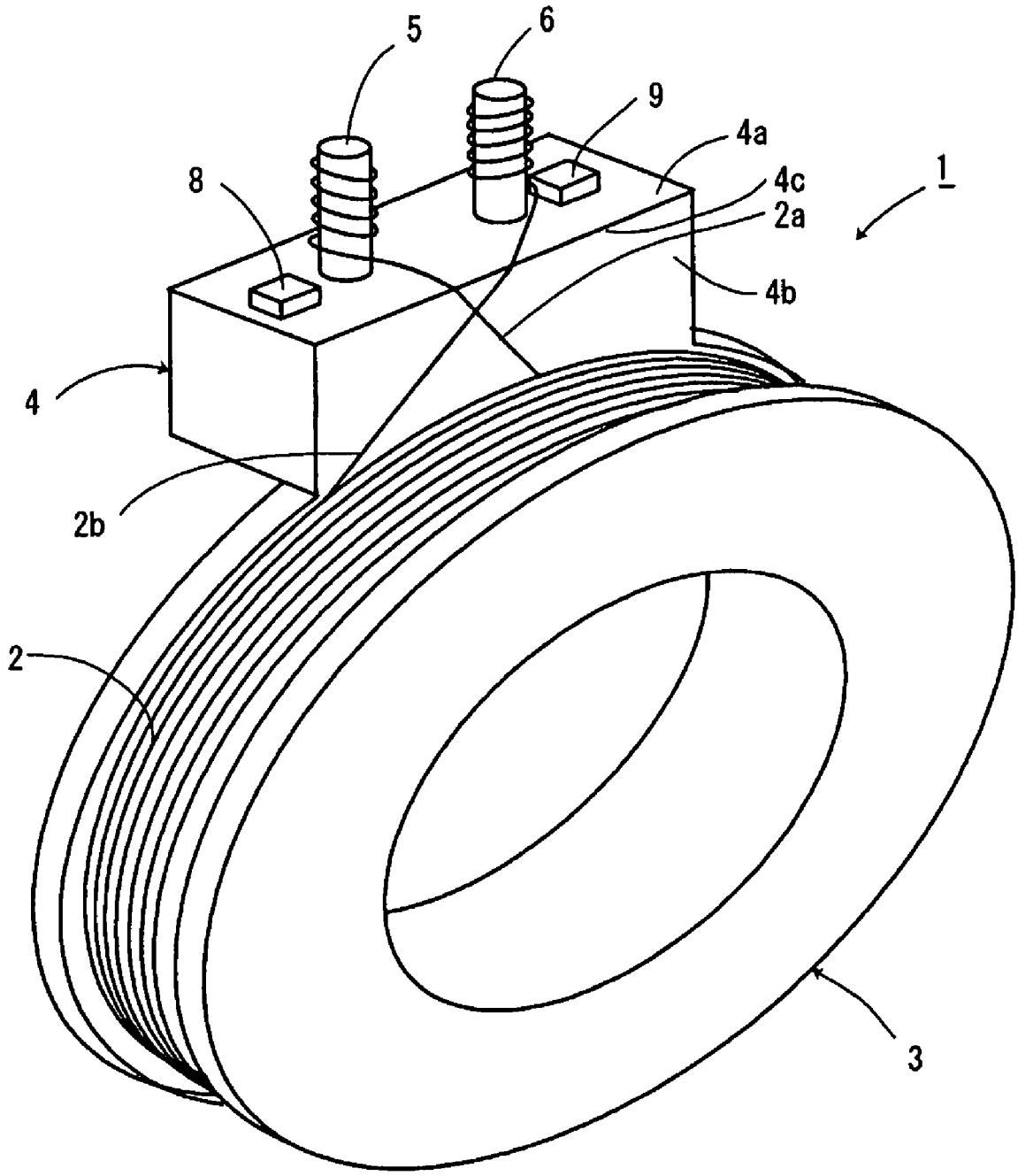

【Fig. 18】
PRIOR ART
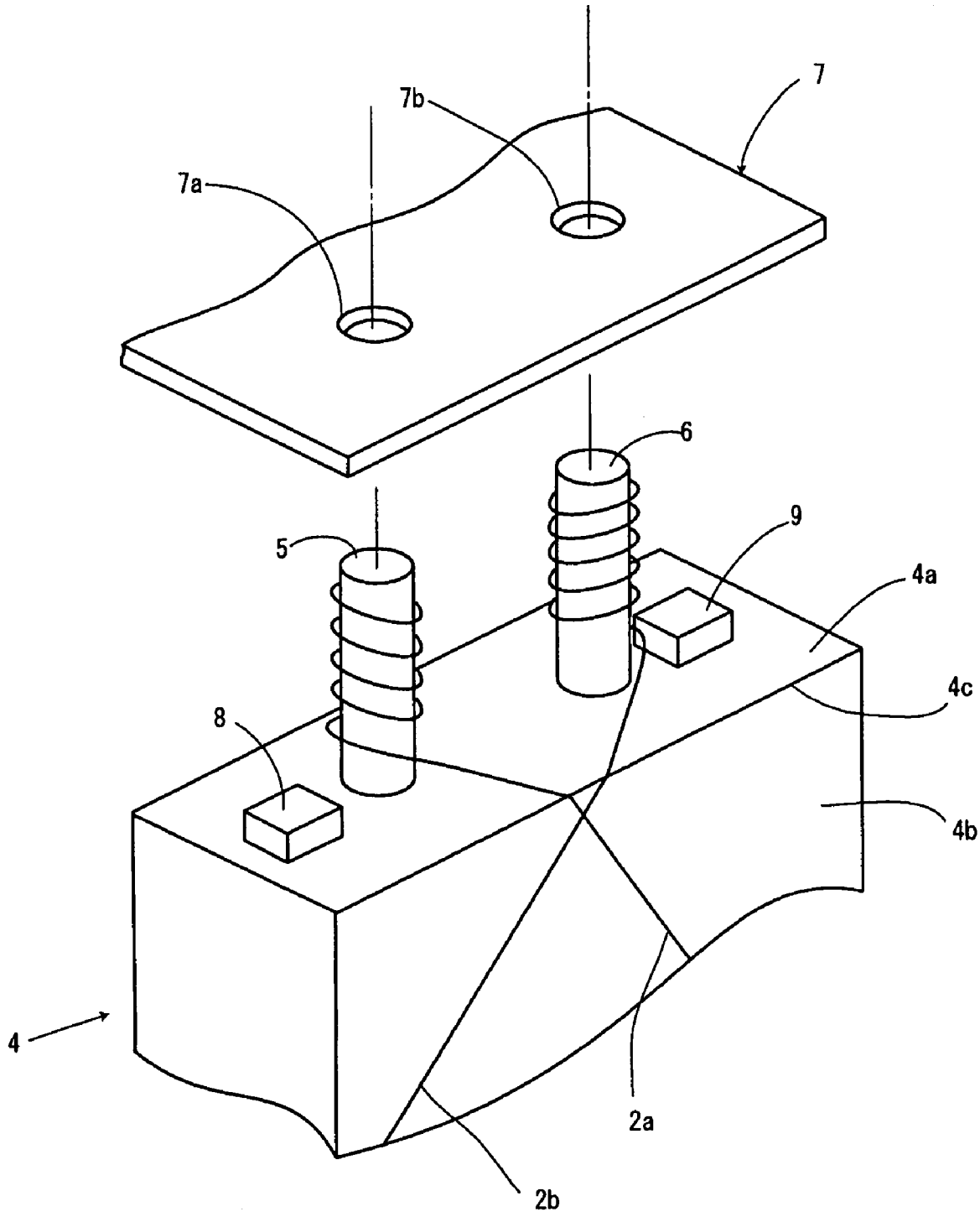

MOTOR WITH INTEGRATED WINDING AND TERMINAL BLOCK

CROSS REFERENCE TO RELATED APPLICATION

The present invention claims priority under 35 U.S.C. §119 to Japanese Application No. 2006-78532 filed Mar. 22, 2006, which is incorporated herein by reference.

FIELD OF THE INVENTION

An embodiment of the present invention may relate to a motor in which an end part of a winding is bound around a terminal pin that is protruded from a wall face of a terminal block.

BACKGROUND OF THE INVENTION

A conventional motor such as a stepping motor which is used in an information device or a video device is provided with a coil bobbin having a drum part around which a winding coil is wound (see, for example, Japanese Patent Laid-Open No. 2005-33919).

FIGS. 17 and 18 show an example of a coil bobbin which is used in such a motor. FIG. 17 is a perspective view showing a coil bobbin in a state where a winding is provided and FIG. 18 is an enlarged perspective view showing a part of the coil bobbin.

In FIGS. 17 and 18, the coil bobbin 1 includes a drum part 3 around which a winding 2 is provided, a terminal block 4 formed on an outer peripheral side of the drum part 3, and a pair of terminal pins 5 and 6 protruded from a wall face 4*a* of the terminal block 4. Respective end parts 2*a* and 2*b* of the winding 2 are bound around the respective terminal pins 5 and 6.

In this case, the respective end parts 2*a* and 2*b* are wound around the drum part 3 in a state where they are extended along the wall face 4*a* and another wall face 4*b* perpendicular to the wall face 4*a* of the terminal block 4.

Further, as shown in FIG. 18, the respective terminal pins 5 and 6 penetrate through mounting holes 7*a* and 7*b* of a flexible printed circuit board 7. In this manner, the flexible printed circuit board 7 is connected to the respective terminal pins 5 and 6.

In a motor structured as described above, the end parts 2*a* and 2*b* of the winding 2 are wired between the drum part 3 and the terminal pins 5 and 6 in a state where they are disposed along the wall face 4*a* and another wall face 4*b*. Therefore, when the flexible printed circuit board 7 is connected to the terminal pins 5 and 6, a tensile load is applied to the end parts 2*a* and 2*b* of the winding 2 at an edge part 4*c* formed with the wall face 4*a* and the wall face 4*b*, and a contact pressure force of the flexible printed circuit board 7 is also applied to the end parts 2*a* and 2*b* at the edge part 4*c* and thus the end parts 2*a* and 2*b* of the winding 2 may be cut off.

In order to prevent this problem, as shown in FIGS. 17 and 18, protruded parts 8 and 9 are provided on the upper wall face 4*a* to cause the flexible printed circuit board 7 to lift from the upper wall face 4*a* (see, for example, Japanese Patent Laid-Open No. 2004-147426).

However, in the case that the above-mentioned protruded parts 8 and 9 are provided, when the end parts 2*a* and 2*b* of the winding 2 are mechanically wound around the terminal pins 5 and 6, the protruded parts 8 and 9 act as an obstacle for movement of a mechanical arm or the like of a coil winding machine. Therefore, windings of the end parts 2*a* and 2*b* are difficult to start from root portions of the terminal pins 5 and 6 and thus the end parts 2*a* and 2*b* are unable to be sufficiently wound around the terminal pins 5 and 6.

SUMMARY OF THE INVENTION

In view of the problems described above, an embodiment of the present invention may advantageously provide a motor which is capable of preventing end parts of a winding extended between a drum part (alternatively, pole teeth instead of the drum part) and terminal pins from being cut or damaged and, in addition, in which the end part of the winding is capable of winding from a root portion of the terminal pin.

Thus, according to an embodiment of the present invention, there may be provided a motor including a coil bobbin which includes a drum part around which a winding is provided, a terminal block which is formed on an outer periphery of the coil bobbin, at least a pair of terminal pins which are protruded from a first wall face of the terminal block, and a groove part which is formed in the first wall face of the terminal block and is opened to a second wall face of the terminal block that is perpendicular to the first wall face. In this motor, both ends of the winding are respectively bound to a pair of the terminal pins from the second wall face side through the groove part of the terminal block. In this case, specifically, the coil bobbin may be structured of the drum part and the terminal block which are integrated with each other by integral molding, and the groove part is integrally formed at the time of the integral molding.

Further, according to an embodiment of the present invention, there may be provided a motor including a stator core which includes a plurality of pole teeth around which a winding is provided, a terminal block which is provided on an outer peripheral side of the stator core, at least a pair of terminal pins which are protruded from a first wall face of the terminal block, and a groove part which is formed in the first wall face of the terminal block and is opened to a second wall face of the terminal block that is perpendicular to the first wall face. In this motor, both ends of the winding are respectively bound to a pair of the terminal pins from the second wall face side through the groove part of the terminal block. In this case, the stator core may include a terminal block attaching part and the terminal block is fixed to the terminal block attaching part of the stator core.

According to a motor in accordance with the embodiment of the present invention, a groove part is formed in the first wall face of the terminal block so as to open to the second wall face of the terminal block, and both ends of the winding are respectively bound to a pair of the terminal pins from the second wall face side through the groove part of the terminal block. Therefore, cutting or damage of the end part of the winding due to the edge part of the terminal block can be prevented. Further, since protruded parts or the like are not necessary in the terminal block, the end part of the winding can be wound around from the root portion of the terminal pin.

In accordance with an embodiment, the groove part which is formed in the first wall face of the terminal block is extended in a vicinity of a root portion of the terminal pin.

According to a motor in accordance with the embodiment in which the groove part is extended in a vicinity of the root portion of the terminal pin, for example, since a contact pressure force from a flexible printed circuit board may not be applied to the end parts of the winding, cutting or damage of the end parts of the winding can be prevented.

In accordance with an embodiment, chamfering is performed on an edge part which is formed by providing the groove part.

According to a motor in accordance with the embodiment in which chamfering is performed on an edge part formed by providing the groove part, cutting or damage of the end part of the winding at the edge part can be prevented.

In accordance with an embodiment, the groove part is formed between a pair of the terminal pins.

According to a motor in accordance with the embodiment in which the groove part is formed between a pair of the terminal pins, the structure of the terminal block can be simplified. In this case, since the groove part is formed between a pair of the terminal pins, even when the terminal pins are integrally molded to the terminal block, a space for fixing the terminal pin is secured and thus the terminal pin can be fixed without a problem.

In accordance with an embodiment, the both ends of the winding are bound to the terminal pins from an inner side of the terminal block.

According to a motor in accordance with the embodiment in which the both end parts of the winding are bound to the terminal pins from an inner side of the terminal block, binding of the end part of the winding to the terminal pin can be performed easily.

In accordance with an embodiment, a guide groove is formed in the second wall face of the terminal block so as to be in communication with the groove part for continuously guiding one of the both ends of the winding to the groove part.

According to a motor in accordance with this embodiment, one of the end parts of the winding is located within the guide groove and thus the end parts can be crossed in a surely separated state at a position where the end parts are crossed each other.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 1 is a plan view showing a part of a coil bobbin in a motor in accordance with a first embodiment of the present invention in a state where a winding is provided.

FIG. 2 is a front view showing the coil bobbin in the motor in accordance with the first embodiment in the state where the winding is provided.

FIG. 3 is a plan view showing the coil bobbin in the motor in accordance with the first embodiment.

FIG. 4 is a front view showing the coil bobbin in the motor in accordance with the first embodiment.

FIG. 5 is an enlarged perspective view showing a part of the coil bobbin in the motor in accordance with the first embodiment.

FIG. 6 is an enlarged perspective view showing a part of the coil bobbin in a modified example of the first embodiment.

FIG. 7 is a plan view showing a part of a coil bobbin in a motor in accordance with a second embodiment of the present invention in a state where a winding is provided.

FIG. 8 is a front view showing the coil bobbin in the motor in accordance with the second embodiment in the state where the winding is provided.

FIG. 9 is an enlarged perspective view showing a portion around one of terminal pins in the motor in accordance with the second embodiment.

FIG. 10 is an enlarged perspective view showing a portion around the other of the terminal pins in the motor in accordance with the second embodiment.

FIG. 11 is a plan view showing a part of a coil bobbin in a motor in accordance with a third embodiment of the present invention in a state where a winding is provided.

FIG. 12 is a front view showing the coil bobbin in the motor in accordance with the third embodiment in the state where the winding is provided.

FIG. 13 is an enlarged perspective view showing a portion around one of terminal pins in the motor in accordance with the third embodiment.

FIG. 14 is a front view showing a stator core in accordance with a fourth embodiment of the present invention in a state where a winding is provided in a motor.

FIG. 15 is a cross-sectional view showing a motor in accordance with an embodiment of the present invention.

FIG. 16 is a cross-sectional view showing a motor in accordance with another embodiment of the present invention.

FIG. 17 is a perspective view showing a coil bobbin used in a conventional motor in a state where a winding is provided.

FIG. 18 is an enlarged perspective view showing a part of a coil bobbin which is used in a conventional motor.

DETAILED DESCRIPTION OF THE PREFERRED EMBODIMENTS

A motor in accordance with an embodiment of the present invention will be described below with reference to the accompanying drawings.

FIG. 15 shows an example of a motor in accordance with an embodiment of the present invention and is a cross-sectional view showing the motor.

As shown in FIG. 15, a motor (which is a stepping motor in this embodiment but is simply referred to as a motor) includes a rotor 100 and a stator 200.

The rotor 100 is provided with a rotor shaft 110 and a rotor magnet (permanent magnet) 120 which is fixed to the rotor shaft 110. Vicinity of both ends in the drawing of the rotor shaft 110 is rotatably supported through radial bearings 140 which are fitted to side plates 130 fixed to the stator 200.

The stator 200 is arranged within a curling case 150 which is formed of a magnetic metal member formed in a roughly cylindrical shape (or a pair of semi-cylindrical shape) and is provided with a pair of stator core assemblies 210 and 220 disposed along an axial direction of the rotor shaft 110. Further, a rotor 100 is rotatably disposed in an inside of the stator 200. The respective stator core assemblies 210 and 220 include outer yokes 211 and 221 disposed on outer sides in an axial direction and inner yokes 212 and 222 adjacently disposed to each other in their superposed state. The respective stator core assemblies 210 and 220 are provided with coil bobbins 10 and 10' in hollow parts which are formed with the outer yoke 211 and the inner yoke 212 and with the outer yoke 221 and the inner yoke 222.

The outer yokes 211 and 221 and the inner yokes 212 and 222 are structured of a magnetic metal member and they form a magnetic path together with the curling case 150. Pole teeth which are disposed to face an outer peripheral face of the rotor magnet 120 are arranged on inner peripheral sides of the outer yokes 211 and 221 and the inner yokes 212 and 222. Further, the outer yoke 211, the inner yoke 212 and the outer yoke 221, the inner yoke 222 are integrally formed with the coil bobbins 10 and 10' made of resin for disposing the windings 11 and 11'. A space between the outer yoke 211 and the inner yoke 212 to be paired, and a space between the outer yoke 221 and the inner yoke 222 to be paired are respectively winding spaces for arranging the windings 11 and 11'.

When an electric current is supplied to the windings 11 and 11', the rotor 100 is rotated by the electric current and a magnetic force of the rotor magnet 120.

A motor in accordance with an embodiment of the present invention is not limited to the above-mentioned motor. The present invention may be applied to, for example, a motor as shown in FIG. 16 or a general motor provided with the coil bobbins 10 and 10'. FIG. 16 shows another example of a motor in accordance with an embodiment of the present invention and is a cross-sectional view showing the motor.

In FIG. 16, a motor (which is a stepping motor in this embodiment but is simply referred to as a motor) includes a rotor 300 and a stator 400.

The rotor 300 is provided with a rotor shaft 310 and a rotor magnet (permanent magnet) 320 which is fixed to the rotor shaft 310.

One end of the rotor shaft 310 is abutted with a bearing 340 which is held in a bracket 330 formed in a "U"-shape in cross section that is fixed to the stator 400, and the other end of the rotor shaft 310 is abutted with a bearing 360 which is held in a bearing hold member 350 that is fixed to the stator 400. The bearing 360 is urged by an urging member 370 toward the rotor shaft 310. Further, steel balls 380 and 390 are disposed between both ends of the rotor shaft 310 and the bearings 340 and 360.

The stator 400 is provided with a pair of stator core assemblies 410 and 420 disposed along an axial direction of the rotor shaft 310. Further, the rotor 300 is rotatably disposed in an inside of the stator 400. The respective stator core assemblies 410 and 420 are structured of outer yokes 411 and 421 disposed on outer sides in an axial direction and inner yokes 412 and 422 adjacently disposed to each other in their superposed state. Further, coil bobbins 10 and 10' are arranged in hollow parts which are formed with the outer yoke 411 and the inner yoke 412, and the outer yoke 421 and the inner yoke 422.

A plurality of pole teeth 413 and 423 is raised from inner circumferential edge portions of the outer yokes 411, 421 and the inner yokes 412, 422 in a circumferentially parallel row state so as to face the rotor magnet 320.

When an electric current is supplied to the windings 11 and 11' which are wound around the coil bobbins 10 and 10', the rotor 300 is rotated by the electric current and a magnetic force of the rotor magnet 320.

First Embodiment

FIGS. 1 through 5 show a coil bobbin in a motor in accordance with a first embodiment of the present invention.

FIG. 1 is a plan view showing a part of a coil bobbin in a state where a winding is provided. FIG. 2 is a front view showing the coil bobbin in the state where the winding is provided. FIG. 3 is a plan view showing the coil bobbin, FIG. 4 is a front view showing the coil bobbin, FIG. 5 is an enlarged perspective view showing a part of the coil bobbin, and FIG. 6 is an enlarged perspective view showing a part of a coil bobbin in a modified embodiment.

As shown in FIGS. 3 and 4, the coil bobbins 10, 10' which are used in a motor in accordance with the first embodiment are provided with drum parts 12 and 12' on which the windings 11 and 11' are mounted, and terminal blocks 13 and 13' (also shown in FIGS. 15 and 16) which are integrally molded on outer peripheral sides of the drum parts 12 and 12'. The coil bobbins 10 and 10' are formed substantially in the same shape and are disposed to superpose on each other along a motor axial line direction in a state that they are reversed in a vertical direction of paper. Back faces of the coil bobbins 10, 10' and the respective terminal blocks 13, 13' are faced each other to be superposed and assembled each other. Therefore, in the description hereafter, except a case when both the coil bobbins 10 and 10' are mutually related to each other, a structure of the coil bobbin 10 will be described below and a description of the coil bobbin 10' is omitted. Further, in the coil bobbins 10 and 10' in the description below, the same notational symbols are used for substantially the same structure and their description is omitted.

As shown in FIGS. 1 and 2, a pair of terminal pins 14 and 15 (also shown in FIGS. 15 and 16) is protruded from a first wall face 13*a* of the terminal block 13. Respective end parts 11*a* and 11*b* of the winding 11 (also shown in FIGS. 15 and 16) are bound around the respective terminal pins 14 and 15. Further, the terminal pins 14 and 15 are insert-molded into the terminal block 13 when the drum part 12 and the terminal block 13 are integrally molded to each other. In this case, as shown in FIG. 4, lower ends 14*a* and 15*a* of the terminal pins 14 and 15 are bent in a wedge-like shape so as not to draw out from the terminal block 13. Further, a groove part 13*c* which is opened to the first wall face 13*a* and to a second wall face 13*b* perpendicular to the first wall face 13*a* is formed in the wall face 13*a* of the terminal block 13. The groove part 13*c* is also formed by integral molding when the drum part 12 and the terminal block 13 are integrally molded to obtain the coil bobbin 10.

When the respective back faces of the coil bobbins 10, 10' are facing each other to be superposed, the terminal pins 14 and 15 are disposed in a displaced manner on respective opposite sides of the terminal blocks 13 and 13' that the respective terminal pins 14 and 15 are positioned at equal intervals. In the first embodiment, the terminal pins 14 are disposed such that they are located on an outer side of the terminal blocks 13 and 13', and the terminal pins 15 are disposed such that they are located on a center side of the terminal blocks 13 and 13'. Therefore, portions between the terminal pins 14 and 15 of the terminal blocks 13 and 13' are used as a common space and an outer side (opposite side of the terminal pin 14) of the terminal pin 15 located on the center side is used as a dedicated space for the terminal pin 15. Therefore, the lower ends 14*a* of the terminal pins 14 are formed to be bent toward the inside of the terminal blocks 13 and 13' because it is difficult to secure a space on an outer side of the terminal blocks 13 and 13'. Further, the lower ends 15*a* of the terminal pins 15 are formed to be bent toward both sides of the terminal blocks 13 and 13' so as not to largely enter into on the side of the terminal pin 14 of the terminal blocks 13 and 13'.

The groove part 13*c* is arranged between the terminal pins 14 and 15, in other words, in the common space for the terminal pins 14 and 15. Therefore, the groove part 13*c* is formed at one position in the terminal block 13 and the groove part 13*c* is used as the common groove part 13*c* for the terminal pins 14 and 15. In this case, the lower end 14*a* of the terminal pin 14 is required to be bent toward the inside and thus the position of the groove part 13*c* is preferably formed to be shifted on the terminal pin 15 side in consideration of strength after the groove part 13*c* has been formed. Further, the groove part 13*c* is formed to a halfway part in a thickness direction (vertical direction in FIG. 1) of the first wall face 13*a* of the terminal block 13. In addition, as shown in FIG. 5, chamfered parts 13*d* comprising a round-curved face (or an inclined face) are formed in the groove part 13*c* so as to spread wider toward the first wall face 13*a* from both end portions of the groove part 13*c* in a widthwise direction (arranging direction of the terminal pins 14 and 15) of the terminal block 13. The chamfered parts 13*d* has a function to cause the groove part 13*c* to gradually approach to the terminal pins 14 and 15.

In the structure described above, the coil bobbin 10 is mounted on a coil winding machine not shown and, for example, an end part 11*b* on a winding start side is wound around the terminal pin 15 and wound around several times toward a tip end of the terminal pin 15 to be bound and held with the terminal pin 15.

Next, after the coil winding machine is rotated to wind and provide a winding 11 around the drum part 12, an end part 11*a* on a winding end side is wound around the terminal pin 14 and, similarly to the winding start operation, the end part 11*a* is wound around several times toward a tip end of the terminal pin 14 to be bound and held with the terminal pin 14.

In this case, the end parts 11*a* and 11*b* are guided by the common groove part 13*c*. Therefore, the end parts 11*a* and 11*b* which are guided by the groove part 13*c* formed between the terminal pins 14 and 15 are naturally wound in a state that they are wound from the inner side to the outer side of the terminal pins 14 and 15 and thus a natural binding operation can be obtained.

On the contrary, for example, when the end part 11*a* on the winding end side is wound from the outer side of the terminal pin 14, the end part 11*a* is drawn out from the right side of the drum part 12 in FIG. 2, i.e., from an opposite side to the terminal pin 14 with respect to the center of the drum part 12. In this case, another groove part which is different from the groove part 13*c* is required to be formed in the first wall face 13*a* on an outer side of the terminal pin 14 and the end part 11*a* is drawn back by the another groove part and thus tensile load becomes extremely large. On the other hand, when the end part 11*a* is drawn from the left side of the drum part 12 in FIG. 2, i.e., from the terminal pin 14 side, another groove part which is different from the groove part 13*c* is also required to be formed in the wall face 13*a* on an outer side of the terminal pin 14. Further in addition, since the end part 11*a* is drawn out from the outermost periphery of the winding 11, a part of the end part 11*a* is positioned at a recessed boundary portion between the drum part 12 and the terminal block 13 (see the end part 11*a* shown by the two-dot chain line in FIG. 2).

In accordance with an embodiment, the chamfered part 13*d* may be formed in the entire edge part which is formed by forming the groove part 13*c* in the first wall face 13*a* and the second wall face 13*b*. Further, as shown in FIG. 6, a bottom face of the groove part 13*c* may be formed in an inclined face 13*e* which approaches the first wall face 13*a* nearer toward the right side direction (in the thickness direction of the terminal block 13 ) such that an angle defined by the bottom face of the groove part 13*c* and the second wall face 13*b* becomes an obtuse angle preferably as much as possible.

As described above, in the motor in accordance with the first embodiment of the present invention, the groove part 13*c* is provided in the first wall face 13*a* of the terminal block 13. Therefore, even when a flexible printed circuit board not shown in the drawing is attached to the terminal block 13, the end parts 11*a* and 11*b* of the winding 11 which are located at the edge part formed with the first wall face 13*a* and the second wall face 13*b* may not contact with the flexible printed circuit board and thus cutting or damage of the end parts 11*a* and 11*b* due to a contact pressure force from the flexible printed circuit board can be prevented. Further, a protruded part or the like for lifting the flexible printed circuit board from the first wall face 13*a* of the terminal block 13 is not necessary and thus the end parts 11*a* and 11*b* of the winding 11 can be wound around from the root portions of the terminal pins 14 and 15.

In addition, since the end parts 11*a* and 11*b* of the winding 11 are wound from the inner side to the outer side of the terminal pins 14 and 15, the end parts 11*a* and 11*b* can be wound from the vicinity of the root portions of the terminal pins 14 and 15. Therefore, cutting or damage of the end parts 11*a* and 11*b* due to a contact pressure force when the flexible printed circuit board is attached to the terminal pins 14 and 15 can be prevented more effectively and the flexible printed circuit board can be fixed to the terminal pins 14 and 15 at a position near the first wall face 13*a* of the terminal block 13.

Further, since the chamfered part 13*d* is formed in the groove part 13*c*, the groove part 13*c* is gradually approached to the terminal pins 14 and 15. Therefore, a tensile load to the winding 11 at the time of winding of the end parts 11*a* and 11*b* to the terminal pins 14 and 15 can be reduced and thus cutting or damage at the time of winding of the end parts 11*a* and 11*b* to the terminal pins 14 and 15 can be prevented.

Second Embodiment

FIGS. 7 through 10 show a motor in accordance with a second embodiment of the present invention.

FIG. 7 is a plan view showing a part of a coil bobbin in a state where a winding is provided and FIG. 8 is a front view showing the coil bobbin in the state where the winding is provided. FIG. 9 is an enlarged perspective view showing a portion around one of terminal pins and FIG. 10 is an enlarged perspective view showing a portion around the other of the terminal pins.

Also in this second embodiment, similarly to the first embodiment, coil bobbins 10 and 10' which are formed in substantially the same shape are used and disposed to superpose on each other along a motor axial line direction in a state that they are reversed in a vertical direction. Therefore, in the description below, a structure of the coil bobbin 10 will be described and a description of the coil bobbin 10' is omitted except referring the same notational symbols. Further, the same notational symbols are used in the substantially same structure as the first embodiment and their description is omitted.

As shown in FIGS. 7 and 8, the coil bobbin 10 used in a motor in accordance with the second embodiment is provided with a drum parts 12 on which a winding 11 is provided, a terminal block 23 which is integrally molded on an outer peripheral side of the drum part 12, and a pair of terminal pins 14 and 15 which are protruded from a first wall face 23*a* of the terminal block 23.

Respective end parts 11*a* and 11*b* of the winding 11 are bound up to the respective terminal pins 14 and 15. The terminal pins 14 and 15 are insert-molded in the terminal block 23 when the drum part 12 and the terminal block 23 are integrally molded together. Further, groove parts 23*c*, 23*d* and 23*e* are formed in the first wall face 23*a* of the terminal block 23 so as to open to the first wall face 23*a* and to the second wall face 23*b* perpendicular to the first wall face 23*a* at the time of integral molding as described above.

The groove part 23*c* is formed between the terminal pins 14 and 15, i.e., in a common space of the terminal pins 14 and 15. The groove part 23*c* is formed over the overall width of the first wall face 23*a* of the terminal block 23 in the vertical direction in FIG. 7 and is communicated with a groove part 23*e* which is formed in the other coil bobbin 10'. In this embodiment, both the end parts 11*a* and 11*b* of the winding 11 are not passed through the groove part 23*c* but the groove part 23*c* may be used for other types of motor and thus the coil bobbin 10 can be used commonly in many types of motor.

The groove part 23*d* is formed at a corner of the terminal block 23 on an outer side of the terminal pin 14 and is also opened to the second side wall face of the terminal block 23. Further, as shown in FIG. 9, the groove part 23*d* may be provided with a round-shaped chamfering 23*f* for reducing load at the time of drawing back of the end part 11*a* and provided with a composite inclined face 23*g* for guiding the end part 11*a* to the terminal pin 14.

The groove part 23*e* is formed on an outer side of the terminal pin 15 and is in communication with a groove part 23*c* formed in the other coil bobbin 10'. Further, as shown in FIG. 10, the groove part 23*e* is formed with a chamfered part 23*h* which is inclined (curved face may be formed) downward on the drum part 12 side in the vicinity of an edge part formed by the first wall face 23*a* and the second wall face 23*b*.

In the structure described above, the coil bobbin 10 is mounted on a coil winding machine not shown in the drawing and, for example, an end part 11*b* on a winding start side is wound around the terminal pin 15 and then wound around several times toward a tip end of the terminal pin 15 to be bound and held with the terminal pin 15.

Next, after the coil winding machine is rotated to wind and provide a winding 11 around the drum part 12, an end part 11*a* on a winding end side is wound around the terminal pin 14 and, similarly to the winding start operation, the end part 11*a* is wound around several times toward a tip end of the terminal pin 14 to be bound and held with the terminal pin 14. In this case, the end part 11*a* passes through the groove part 23*d* and the end part 11*b* passes through the groove part 23*e*.

As described above, in the motor in accordance with the second embodiment of the present invention, the groove parts 23*c*, 23*d* and 23*e* are provided in the first wall face 23*a* of the terminal block 23. Therefore, even when a flexible printed circuit board not shown in the drawing is attached to the terminal block 23, the end parts 11*a* and 11*b* of the winding 11 which are located at the edge part formed with the first wall face 23*a* and the second wall face 23*b* may not contact with the flexible printed circuit board and thus cutting or damage of the end parts 11*a* and 11*b* due to a contact pressure force from the flexible printed circuit board can be prevented. Further, a protruded part or the like for lifting the flexible printed circuit board from the first wall face 23*a* of the terminal block 23 is not necessary and thus the end parts 11*a* and 11*b* of the winding 11 can be wound around from the root portions of the terminal pins 14 and 15. Therefore, cutting or damage of the end parts 11*a* and 11*b* due to a contact pressure force when the flexible printed circuit board is attached to the terminal pins 14 and 15 can be prevented more effectively and the flexible printed circuit board can be fixed to the terminal pins 14 and 15 at a position near the first wall face 23*a* of the terminal block 23.

Third Embodiment

In the second embodiment, as shown in FIG. 8, the end part 11*b* on the winding start side is drawn into an inner side of the drum part 12 while approaching along the second wall face 23*b* from the groove part 23*e*, and the end part 11*b* on the winding end side is drawn out to the groove part 23*d* while approaching to the second wall face 23*b* from an outer side of winding on the drum part 12.

Therefore, apart distances of the end parts 11*a* and 11*b* from the second wall face 23*b* in a crossing portion shown in FIG. 8 (portion shown by the circle "P") are different from each other and thus the end parts 11*a* and 11*b* are not contacted with each other in the crossing portion.

However, winding end position of the end part 11*a* can not be accurately set at a constant position and thus an apart distance of the end part 11*a* from the second wall face 23*b* does not become a constant value.

Therefore, when the end part 11*a* is drawn out from the drum part 12, there is a possibility that the end part 11*a* and the end part 11*b* come into contact with each other in the crossing portion "P".

The contact of the end parts 11*a* and 11*b* with each other may cause disconnection or short circuit of the winding 11 and thus it is preferable to set in a state that the end part 11*a* does not come into contact with the end part 11*b*.

FIGS. 11 and 12 show a structural example in accordance with a third embodiment in which contacting of the end parts 11*a* and 11*b* with each other is prevented. FIG. 11 is a plan view showing a part of a coil bobbin in a state where a winding is provided, FIG. 12 is a front view showing the coil bobbin in the state where the winding is provided, and FIG. 13 is an enlarged perspective view showing a portion around one of the terminal pins.

In FIGS. 11 and 12, the same notational symbols are used in the substantially same structure as the second embodiment and their description is omitted.

In the third embodiment, as shown in FIGS. 11 and 12, a guide groove 23*i* which is in communication with the groove part 23*e* and extended to the drum part 12 is formed in the second wall face 23*b* of the terminal block 23 in which the end part 11*b* on the drawing start side to the drum part 12, i.e., the winding start side is accommodated into an inner side of the second wall face 23*b* to be guided into the drum part 12 through the groove part 23*e* from the terminal pin 15.

In accordance with the third embodiment, the end part 11*b* which is originally located on the second wall face 23*b* side of the end part 11*a* disposed in a crossing relationship with the end part 11*b* is drawn in a state that the end part 11*b* is accommodated into the inside of the surface of the second wall face 23*b*. Therefore, the end parts 11*a* and 11*b* are prevented from coming into contact with each other to cause disconnection or a short circuit. Further, a protruded part or the like for lifting a flexible printed circuit board from the first wall face 23*a* of the terminal block 23 is not necessary and thus the end parts 11*a* and 11*b* of the winding 11 can be wound around from the root portions of the terminal pins 14 and 15. Therefore, disconnection or damage of the end parts 11*a* and 11*b* due to a contact pressure force when the flexible printed circuit board is attached to the terminal pins 14 and 15 can be prevented more effectively and the flexible printed circuit board can be fixed to the terminal pins 14 and 15 at a position near the first wall face 23*a* of the terminal block 23.

The guide groove 23*i* may be applied to the first embodiment. In this case, the guide groove 23*i* is extended along the end part 11*b* and is formed so as to be in communication with the groove part 13*c*. Further, for example, like the groove part 23*c* as shown in FIG. 13, the groove part 23*c* may be formed to a position of a base part face of the terminal pin 15 so that a portion of the end part 11*b* protruding from the first wall face 23*a* is minimized. In this manner, the relationship between the respective grooves 13*c*, 23*c*, 23*d* and 23*e* and the terminal pins 14 and 15 may be modified as described above.

Fourth Embodiment

FIG. 14 is a front view showing a stator core in a state where a winding is provided in a motor in accordance with a fourth embodiment of the present invention.

In accordance with the first embodiment through the third embodiment, the coil bobbins 10 are structured of the terminal blocks 13 and 23 which are integrated to the drum part 12. However, in the fourth embodiment, the coil bobbin is not used but a terminal block attaching portion 22*a* is formed in a stator core 22 which corresponds to the drum part 12, and a terminal block 33 is press-fitted and fixed to the terminal block attaching portion 22*a* instead of the terminal blocks 13 and 23. In the fourth embodiment, similarly to the first embodiment through the third embodiment, back faces of stator cores 22 in the same shape (including terminal block 33) are faced each other to be superposed but their detail description is omitted.

A pair of terminal pins 14 and 15 are protruded from the first wall face 13*a* of the terminal block 33. Respective end parts 11*a* and 11*b* of the winding 11 are bound to the respective terminal pins 14 and 15. The terminal pins 14 and 15 are insert-molded into the terminal block 33 when the terminal block 33 is integrally molded with the stator core 22. In addition, a groove part 13*c* which is opened to the first wall face 13*a* and the second wall face 13*b* that is perpendicular to the first wall face 13*a* is formed in the first wall face 13*a* of the terminal block 33.

The groove part 13*c* is positioned between the terminal pins 14 and 15, in other words, in a common space for the terminal pins 14 and 15. Therefore, the groove part 13*c* is formed at one position in the terminal block 33 and the groove part 13*c* is used as a common groove part 13*c* for the terminal pins 14 and 15. Further, the groove part 13*c* is formed to a halfway part in a far side direction in the paper in FIG. 14 of the first wall face 13*a* of the terminal block 33, i.e., thickness direction of the terminal block 33. In addition, chamfered parts 13*d* comprised of a round-curved face (or an inclined face) are formed in the groove part 13*c* so as to spread wider toward the first wall face 13*a* from both end portions of the groove part 13*c* in a width direction (arranging direction of the terminal pins 14 and 15) of the terminal block 33. The chamfered parts 13*d* have a function to make the groove part 13*c* gradually approach to the terminal pins 14 and 15.

A plurality of pole teeth 22*b* is formed so as to be raised from an inner periphery of the stator core 22. In FIG. 14, four pole teeth 22*b* are formed in the stator core 22 but more comb teeth-shaped pole teeth may be formed with an equal interval along a circumferential direction of the stator core 22. Not shown in the drawing, pole teeth of the other stator core which is disposed in an axial direction to the stator core 22 are alternately disposed between the pole teeth 22*b* of the stator core 22 with a specified interval in the circumferential direction.

A rotor is disposed so as to be rotatably supported on an inner periphery side of the pole teeth 22*b*. In other words, the pole teeth 22*b* are oppositely disposed on an outer peripheral side of a rotor magnet to structure a motor. Magnetic poles are formed in a circumferential direction of the rotor magnet with an equal interval and the rotor is rotated by a specified angle each time when the pole teeth 22*b* are magnetized.

In the structure described above, the stator core 22 is mounted on a coil winding machine not shown in the drawing and, for example, an end part 11*b* on a winding start side is wound around the terminal pin 15 and then wound around several times toward a tip end of the terminal pin 15 to be bound and held with the terminal pin 15.

Next, after the coil winding machine is rotated to wind and provide a winding 11 around the pole teeth 22*b* of the stator core 22, an end part 11*a* on a winding end side is wound around the terminal pin 14 and, similarly to the winding start operation, the end part 11*a* is wound around several times toward a tip end of the terminal pin 14 to be bound and held with the terminal pin 14.

In this case, the end parts 11*a* and 11*b* are guided by one common groove part 13*c*. Therefore, the end parts 11*a* and 11*b* which are guided by the groove part 13*c* formed between the terminal pins 14 and 15 are naturally wound in a state that they are wound from the inner side to the outer side of the terminal pins 14 and 15 and thus a natural binding operation can be obtained.

In the fourth embodiment, the winding 11 is structured by winding a wire around the outer periphery of the pole teeth 22*b* of the stator core 22 by a coil winding machine. However, a winding 11 comprised of an air-core coil may be used which has been structured in advance by a wire that is wound around a rod member, which is a winding core, a plurality of times so as to expose the end parts 11*a* and 11*b* on a surface of the winding. In this case, the winding 11 comprised of an air-core coil is fitted to the outer periphery of the pole teeth 22*b* of the stator core 22, and then the end parts 11*a* and 11*b* are wound around the terminal pins 14 and 15 several times to be bound and hold.

As described above, in the motor in accordance with the fourth embodiment of the present invention, the groove part 13*c* is provided in the first wall face 13*a* of the terminal block 33. Therefore, even when a flexible printed circuit board not shown in the drawing is attached to the terminal block 33, the end parts 11*a* and 11*b* of the winding 11 which are located at the edge part formed with the first wall face 13*a* and the second wall face 13*b* may not contact with the flexible printed circuit board and thus cutting or damage of the end parts 11*a* and 11*b* due to a contact pressure force from the flexible printed circuit board can be prevented. Further, a protruded part or the like for lifting the flexible printed circuit board from the first wall face 13*a* of the terminal block 33 is not necessary and thus the end parts 11*a* and 11*b* of the winding 11 can be wound around from the root portions of the terminal pins 14 and 15.

In addition, since the end parts 11*a* and 11*b* of the winding 11 are wound from the inner side to the outer side of the terminal pins 14 and 15, the end parts 11*a* and 11*b* can be wound from the vicinity of the root portions of the terminal pins 14 and 15. Further, a tensile load to the winding 11 at the time of winding can be reduced and thus cutting or damage at the time of winding of the end parts 11*a* and 11*b* to the terminal pins 14 and 15 can be prevented.

In the fourth embodiment, except that the stator core 22 and the terminal block 33 are formed separately, a structure of the terminal block 33 is similar to the first embodiment through the third embodiment and thus, for example, the grooves (for example, groove 23*c*) other than the groove 13*c* shown in FIG. 14 may be utilized.

Other Embodiments

As described above, the feature of the invention consists in the structure of the coil bobbins 10 and 10', especially in the structure of the terminal blocks 13 and 13'. Therefore, another case other than the curling case 150 may be used as a case for the motor or alternatively, the outer yoke 411 and the inner yoke 412 may be used as the case. Further, in FIGS. 2, 4, 8 and 12, a part of the structure (for example, the flange portion 12*a* of the coil bobbin 10 in FIG. 3 and the pole teeth 412 and 422) is not shown for convenience of explanation.

Further, in FIG. 4, the notational symbols 12*b* and 12*c* mean protruded parts which are formed in the inner yokes 412 and 422. Therefore, when the outer yokes 411 and 421 are fitted to the inner yokes 412 and 422, positioning in a vertical direction of the outer yokes 411 and 421 and the inner yokes 412 and 422 and preventing of circumferential movement of the outer yoke 411 and 421 are performed by the protruded parts 12*b* and 12*c*.

In addition, in FIG. 4, the notational symbol 12*d* means a portion of the core which is not covered with resin (referred to as "core part") and the core part 12*d* is used as an inserting portion of a jig (not shown) for holding the inner yokes 412 and 422 when the coil bobbins 10 and 10' are integrally molded after the inner yokes 412 and 422 have been fixed to each other. As the result, the core part 12*d* is not covered with resin.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A motor comprising:

a coil bobbin which includes a drum part around which a winding having a first end and a second end is provided;

a terminal block which is formed on an outer periphery of the coil bobbin comprising:

a first wall face for attaching at least a pair of terminal pins;

a second wall face which is formed to be extended from the drum part and perpendicular to the first wall face;

a groove part which is formed in the first wall face and is opened to the second wall face; and a chamfered part which is formed on an edge part formed by the groove part and the first wall face over a portion of a passage for the first end and the second end of the winding;

at least a pair of the terminal pins which are protruded from the first wall face of the terminal block; and wherein the first end and the second end of the winding are gradually approached to the pair of terminal pins from the second wall face side through the groove part and the chamfered part between the groove part and the first wall face of the terminal block to be respectively bound to the pair of terminal pins.

2. The motor according to claim 1, wherein the coil bobbin is structured of the drum part and the terminal block which are integrated each other by integral molding, and the groove part is integrally formed at the time of the integral molding.

3. The motor according to claim 2, wherein the groove part is formed between the pair of terminal pins.

4. The motor according to claim 3, wherein the both ends of the winding are bound to the pair of terminal pins from an inner side of the terminal block.

5. The motor according to claim 1, wherein the groove part is extended in a vicinity of a root part of one of the pair of terminal pins.

6. The motor according to claim 1, further comprising a guide groove which is formed in the second wall face of the terminal block so as to be in communication with the groove part and structured to continuously guide one of the first end and the second end of the winding to the groove part.

7. A motor comprising:

a stator core which includes a plurality of pole teeth around which a winding having a first end and a second end is provided;

a terminal block which is provided on an outer peripheral side of the stator core comprising:

a first wall face for attaching at least a pair of terminal pins;

a second wall face which is formed to be extended from the drum part and perpendicular to the first wall face;

a groove part which is formed in the first wall face and is opened to the second wall face; and a chamfered part which is formed on an edge part formed by the groove part and the first wall face over a portion of a passage for the first end and the second end of the winding;

at least a pair of the terminal pins which are protruded from the first wall face of the terminal block; and wherein the first end and the second end of the winding are gradually approached to the pair of terminal pins from the second wall face side through the groove part and the chamfered part between the groove part and the first wall face of the terminal block to be respectively bound to the pair of terminal pins.

8. The motor according to claim 7, wherein the stator core includes a terminal block attaching part and the terminal block is fixed to the terminal block attaching part of the stator core.

9. The motor according to claim 8, wherein the groove part is formed between the pair of terminal pins.

10. The motor according to claim 9, wherein the first end and the second end of the winding are bound to the pair of terminal pins from an inner side of the terminal block.

11. The motor according to claim 7, wherein the groove part is extended in a vicinity of a root part of one of the pair of terminal pins.

12. The motor according to claim 7, further comprising a guide groove which is formed in the second wall face of the terminal block so as to be in communication with the groove part for continuously guiding one of the first end and the second end of the winding to the groove part.

* * * * *